United States Patent [19]

Zbilut et al.

[11] 4,026,234

[45] May 31, 1977

[54] DEVICE FOR COUPLING A BARGE UNIT TO A PUSHER-TUG FOR SEA TRANSPORT

[75] Inventors: Wojciech Zbilut; Walerian Dobromirski; Jerzy Wojtasik, all of Wroclaw, Poland

[73] Assignee: Centrum Badawczo-Projektowe Zeglugi Srodladowej, Wroclaw, Poland

[22] Filed: Oct. 16, 1975

[21] Appl. No.: 623,067

[30] Foreign Application Priority Data

Oct. 19, 1974 Poland ..... 174962

[52] U.S. Cl. ..... 114/248

[51] Int. Cl.[2] ..... B63B 21/00

[58] Field of Search ..... 114/77 R, 235 R, 235 A, 114/242, 248, 249, 251, 253

[56] References Cited

UNITED STATES PATENTS

| | | | |
|---|---|---|---|
| 2,722,907 | 11/1955 | Dyer | 114/235 R |
| 3,483,842 | 12/1969 | Ohcho et al. | 114/235 R |
| 3,486,476 | 12/1969 | Breit | 114/235 R |
| 3,645,225 | 2/1972 | Lunde | 114/235 R |

*Primary Examiner*—Trygve M. Blix
*Assistant Examiner*—Charles E. Frankfort

[57] ABSTRACT

A device for coupling a barge unit to a pusher-tug for sea transport, comprising guiding rollers mounted on the barge on a line perpendicular to the plane of symmetry of the pusher-tug. Two coupling cables pass on the rollers and the cables are connected at one end to shock absorbers at the stern portion of the tug and at opposite ends to hydraulic power devices at the bow portion of the tug. The cable has an inclination angle $\alpha_1$ with respect to the symmetry plane of the tug at the connection with the shock absorber and an inclination angle $\alpha_2$ at the connection with the hydraulic power devices. The angles are selected such that for a preload in the cable equal to force P developed by the hydraulic power devices, the difference between P $\cos\alpha_1$ and P $\cos\alpha_2$ is at least equal to one-half of the force tending to separate the tug and the barge. Each shock absorber has a stroke equal to the difference in the length of the cable at extreme positions of the tug as determined by the pitching and heaving amplitude of the tug.

3 Claims, 2 Drawing Figures

DEVICE FOR COUPLING A BARGE UNIT TO A PUSHER-TUG FOR SEA TRANSPORT

FIELD OF THE INVENTION

The invention relates to devices for coupling a barge unit to a pusher-tug for sea transport.

PRIOR ART

In accordance with the previously proposed and known methods of pushing a barge in sea transport by a pusher-tug, the tug pushes against a nest made in the stern of barge and is coupled to the barge by means of pins on the sides of the pusher-tug which are insertable, by means of hydraulic devices, into longitudinal recesses in the barge stern.

In accordance with other known and used methods for pushing a barge in sea transport, the coupling device includes a pin mounted on the barge and received in bearings mounted in the bow of the pusher-tug, this pin being installed in a recess in the stern portion of the barge in such way that the vertical position of the pin can be adjusted in accordance with the draft of the pusher-tug and the barge.

Also known are coupling devices wherein the barge is coupled to the pusher-tug by means of a pair of long cables, these cables being provided with shock absorbers and passed through roller fairleads installed at both sides in the stern portion of the barge, the mid portion of the barge recess being coupled with the mid portion of the pusher-tug bow by means of articulated elements.

In accordance with still other known and used methods, the bow of the pusher-tug is nested in a recess made in the barge in the form of a cradle and is pressed against this cradle by means of a hydraulic power device installed either in the bow of the pusher-tug or in the stern of the barge.

In coupling devices of still another type, the cables are passed through guiding rollers installed in the barge within the zone of a line perpendicular to the symmetry plane of the pusher-tug, this plane of symmetry passing through the center of buoyancy of the pusher-tug when lying idle in water. The devices of this type do not secure, however, either a constant position of the pusher-tug relative to the barge or a constant pressure of the pusher-tug against the barge.

SUMMARY OF THE INVENTION

An object of the invention is to provide a device for coupling a barge into a unit suitable for pushing by a pusher-tug in sea transport, said device having self-adjusting qualities securing both a constant position of the pusher-tug relative to the barge and a constant pressure of the pusher-tug against the barge both in pushing and reversing, said device also allowing movements of the pusher-tug relative to the barge up to extreme positions determined by the amplitude of pitching and heaving.

This object is achieved by selecting the inclination angles of the coupling cable of the device in such a manner that the difference between the product of the preload force in the cable and the cosine of the inclination angle of this cable in the stern portion of the pusher-tug, and the product of the preload force in the cable and the cosine of the inclination angle of the cable in the bow portion of the pusher-tug is equal to or greater than one-half of the back thrust force pressing the pusher-tug away from the barge.

A hydraulic power device is installed at one end of the coupling cable loosely passed through a set of rollers, a shock absorber being installed at the other end of the said cable, the stroke of the said shock absorber being equal to the difference in length of the coupling cable at the extreme positions determined by pitching and heaving amplitudes of the pusher-tug.

There are also two fenders provided at the transom of the barge, a central fender being provided at the bow of the pusher-tug.

BRIEF DESCRIPTION OF THE DRAWING

An embodiment of the invention will now be described by way of example and with reference to the accompanying drawing in which.

DETAILED DESCRIPTION

Figure 1:
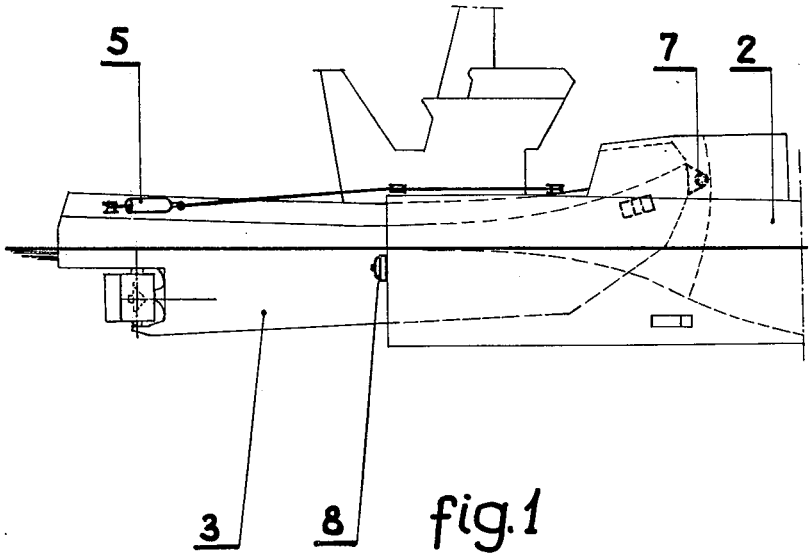
FIG. 1 is a side view of a pushed barge unit coupled together by means of the device according to the invention.
Figure 2:
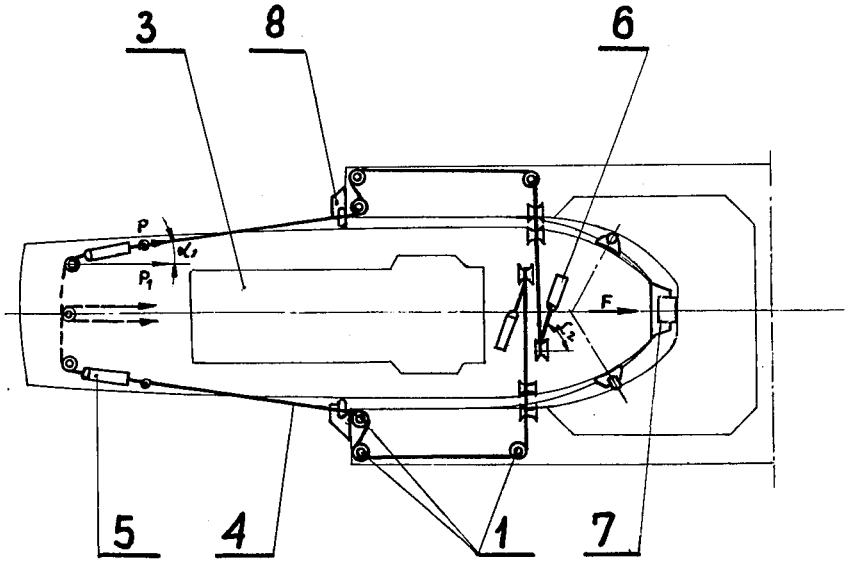
FIG. 2 is a plan view of a pushed barge unit coupled together by means of the device according to the invention.

The coupling device includes a system of guiding rollers being 1, said rollers mounted on the wings of the nest of barge 2, in a lateral plane passing through the center of buoyancy of a pusher-tug 3 lying idle in water.

Cables 4 are passed over the rollers 1, said cables including shock absorbers 5 and hydraulic power devices 6 installed at the cable ends, said shock absorbers and hydraulic power devices being fixed to the deck of the pusher-tug 3, the stroke of the said shock absorbers 5 being equal to the length of cable 4 at extreme positions of the pusher-tug, these positions being determined by the pitching and heaving amplitude of the pusher-tug.

The purpose of hydraulic power devices 6 is to produce a preload being in cables 4, this preload selected in such a manner as to obtain an optimum damping of the pusher-tug movements, since the behavior of the pusher-tug behind the stern is a function of the magnitude of the preload in cable 4. Thus obtained is a damping effect which can be adjusted in accordance with the prevailing sailing conditions and with loading conditions and therefore with associated motions of the barge sailing with the pusher-tug. Inclination angles $\alpha_1$ and $\alpha_2$ of cables 4 are selected in such a way that when the preloading force in the cable is P, the difference between P cos $\alpha_1$ and P cos $\alpha_2$ is equal to or greater than one-half of the force acting on the pusher-tug 3 tending to separate it from the barge 2.

Due to the so selected angles $\alpha_1$ and $\alpha_2$ a constant pressure of the pusher-tug against the barge is obtained both in pushing and reversing, and a constant position of the pusher-tug relative to the barge 2 is obtained due to the ability of the cables 4 to freely move over rollers 1.

There is a single elastic central fender 7 mounted on the bow of the pusher-tug 3, and two side fenders 8 are provided on the barge transom, these fenders damping the lateral motions of the pusher-tug.

What we claim is:

1. A device for coupling a barge unit to a pusher-tug for sea transport, the barge unit having a stern portion with a nest and the tug having a bow adapted for nesting in said nest, said device comprising guiding rollers mounted on the barge on a line perpendicular to the symmetry plane of the pusher-tug, said symmetry plane passing through the center of buoyancy of the pusher-tug lying idle in water, two coupling cables passing on said rollers, said cables having opposite ends, shock absorbers on said tug connected to one of the ends of the cables, hydraulic power devices on said tug connected to the other of the ends of the cables, the pusher-tug being nested against and pushing against the nest provided in the stern portion of the barge, said cable having an inclination angle $\alpha_1$ with respect to the symmetry plane of the tug at a first end of the cable and an inclination angle $\alpha_2$ at a second end of the cable, said angles being selected such that for a preload in the cable equal to force P as developed by the hydraulic power devices, the difference between P cos $\alpha_1$ and P cos $\alpha_2$ is at least equal to one-half of the force tending to separate the pusher-tug and the barge, each shock absorber having a stroke equal to the elongation of the cable at extreme positions of the pusher-tug as determined by the pitching and heaving amplitude of the pusher-tug relative to the barge unit.

2. A device as claimed in claim 1 wherein said power devices are at the bow of the pusher-tug and the shock absorbers are at the stern of the pusher-tug.

3. A device as claimed in claim 2 comprising a front fender on the bow of the pusher-tug and side fenders on the stern transom of the barge.

* * * * *